US005941751A

United States Patent [19]

Johnson et al.

[11] Patent Number: 5,941,751

[45] Date of Patent: Aug. 24, 1999

[54] FLUID-LAUNCHABLE SOUND-GENERATING ARTICLE

[75] Inventors: Lonnie G. Johnson, Smyrna; John T. Applewhite; John A. Alphonso-Gibbs, both of Atlanta, all of Ga.

[73] Assignee: Johnson Research and Development Co., Inc., Smyrna, Ga.

[21] Appl. No.: 08/755,293

[22] Filed: Nov. 22, 1996

Related U.S. Application Data

[63] Continuation-in-part of application No. 08/472,137, Jun. 7, 1995, abandoned.

[51] Int. Cl.[6] ..... A63H 5/00

[52] U.S. Cl. ..... 446/213; 446/397; 446/484

[58] Field of Search ..... 446/213, 397, 446/47, 484, 485, 408, 409, 400

[56] References Cited

U.S. PATENT DOCUMENTS

| | | | |
|---|---|---|---|
| 2,710,490 | 6/1955 | Wildstein | 446/400 |
| 3,733,741 | 5/1973 | Pipa | 446/408 |
| 4,820,236 | 4/1989 | Berliner et al. | 446/484 X |
| 5,316,293 | 5/1994 | Hamilton | 446/485 X |
| 5,439,408 | 8/1995 | Wilkinson | 446/409 |

*Primary Examiner*—Robert A. Hafer
*Assistant Examiner*—Jeffrey D. Carlson
*Attorney, Agent, or Firm*—Michael V. Drew

[57] ABSTRACT

A sound-generating unit (30) is encased within the body (20) of an article (10) which is to be launched by a burst of compressed and/or pressurized fluid (15) from a fluid launching device (11). The sound-generating unit (30) has the three main elements of a piezoelectric electromechanical transducer (32), a sound-generator electronic circuit (40), and a speaker (42). The body (20) of the article to be launched has a bore to receive the burst of fluid (15). The piezoelectric element (32) is positioned within the bore in alignment for receiving the impact of the burst of fluid (15). The piezoelectric element (32), the speaker (42) and an electrical energizer (36) are connected to the sound-generator circuit (40). Upon being impinged by a burst of fluid (15) projected into the bore of the body (20), the piezoelectric element (32) minutely deforms and generates a voltage that is processed by the sound-generator circuit (40) into a desired sound-effect signal that drives the speaker (42). A resonance chamber (31) reinforces and enhances the generated sound.

15 Claims, 3 Drawing Sheets

24
28
42
30
44
40
36
34
15
26
13
11
20
32
22

TRIGGER SWITCH (PIEZOELECTRIC)
32
START/STOP CIRCUIT
46
CONTROL LOGIC
48
N
40
COUNTER
52
$2^N$
MULTIPLEXER
54
AMPLIFIER
56
42
SPEAKER
OSCILLATOR
50
ENERGIZER (2 BATTERIES 1.5V EACH)
36

FLUID-LAUNCHABLE SOUND-GENERATING ARTICLE

RELATED APPLICATIONS

This application is a continuation-in-part of U.S. patent application Ser. No. 08/472,137, filed Jun. 7, 1995, now abandoned.

TECHNICAL FIELD OF THE INVENTION

The present invention relates to toy articles, such as a toy foam rocket, launchable by fluid force, and more particularly to a toy article that automatically generates a sound-effect when it is launched by fluid force.

BACKGROUND OF THE INVENTION

Toy articles that are launchable by fluid force provide entertainment and help educate users. Examples of such toy articles are toy foam rockets and toy vehicles. Fluid-launchable toy articles are desirable because they can be propelled into motion in a safe, inexpensive, reliable manner. The entertainment and educational benefits derived from a launchable toy article may be enhanced if the article exhibits features that further add to the realism of the object or features that themselves also entertain and educate. A sound effect is a feature that is able to enhance the entertainment and educational benefits of a toy article, particularly if the sound effect is made audible in conjunction with the action engaged in by the article. For example, a sound effect that mimics the sound of a rocket being launched would enhance the realism of playing with a toy foam rocket. As another example, a sound effect simulative of sounds used in movies when science fiction-types of weapons are fired would enhance the entertainment, and perhaps the educational, benefits derived from launching a toy rocket. It would be convenient if a sound effect could be simply and automatically generated upon the launching of a fluid-launchable toy article. What is needed is a means for generating a desired sound effect when a fluid-launchable toy article is launched, and in particular a means for utilizing the launching fluid to help generate the sound effect.

SUMMARY OF THE INVENTION

It is an object of the invention to provide a means for generating a desired sound effect when a fluid-launchable toy article is launched.

In the present invention, a sound-generating unit is encased within the body of an article which is to be launched by a burst of compressed and/or pressurized fluid from a fluid launching device. The sound-generating unit has three primary elements, namely, a piezoelectric electromechanical transducer, a sound-generator electronic circuit, and a speaker. The body of the article to be launched has a bore for receiving the burst of fluid. The piezoelectric element is positioned within the bore in alignment for receiving the impact of the burst of fluid. The piezoelectric element, the speaker and an electrical energizer are connected to the sound-generator circuit. When a burst of fluid is projected into the bore the piezoelectric element is impinged, minutely deforms and generates a voltage. The voltage generated is in turn processed by the sound-generator circuit into a desired sound effect signal that drives the speaker. A resonance chamber enhances the sound that is generated.

Other aspects, objects, features, and advantages of the present invention will become apparent to those skilled in the art upon reading the detailed description of preferred embodiments.

DETAILED DESCRIPTION OF PREFERRED EMBODIMENTS OF THE INVENTION

Figure 1:
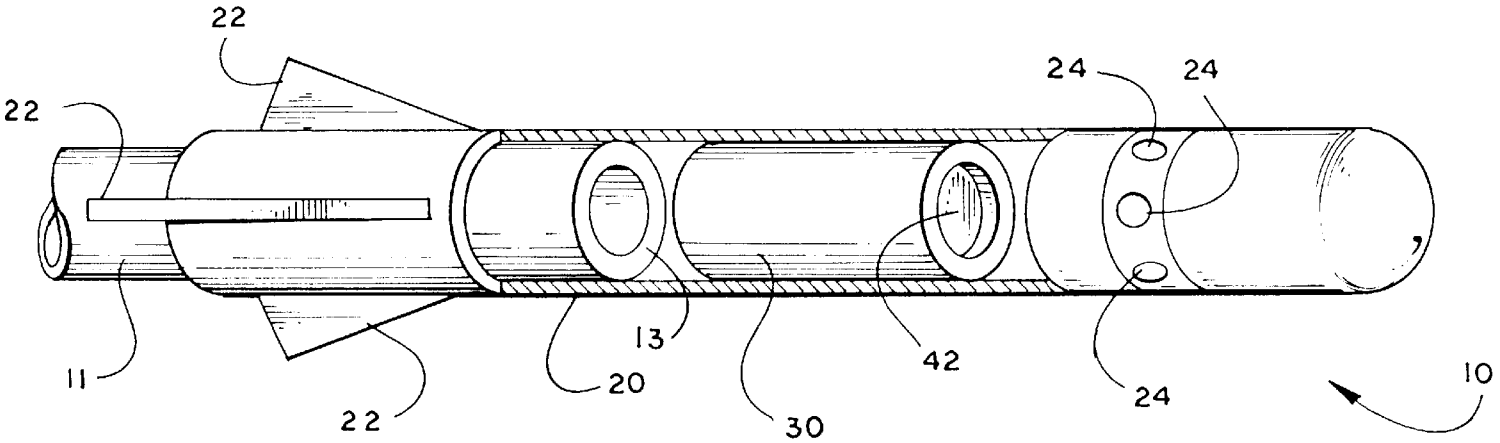
FIG. 1 is an cut-away isometric illustration of a fluid-launchable sound-generating toy foam rocket according to a preferred embodiment of the present invention.

While the specification concludes with claims particularly pointing out and distinctly claiming the subject matter which is regarded as the present invention, the invention will now be described with reference to the following description of embodiments taken in conjunction with the accompanying drawings. Throughout the drawings, the same reference numerals are used to refer to identical features.

A piezoelectric material is one in which a voltage is proportionately produced when mechanical pressure is applied to the material. The invention uses a piezoelectric element as an electromechanical transducer to trigger a voltage signal. The burst of fluid pressure used to propel a toy article is the mechanical pressure applied to the piezoelectric element that causes the voltage signal to be generated. An electronic circuit then processes the voltage signal into a designated sound effect which is broadcasted by a loudspeaker. Referring first to FIG. 1, therein is illustrated a fluid-launchable sound-generating toy article, namely a toy rocket, 10 according to a preferred embodiment of the invention. In the cut-away view of FIG. 1 there can be clearly seen a nozzle 11 for projecting a burst of fluid 15 (not illustrated in FIG. 1) into the base of the rocket 10 to launch the article 10. The body 20 of the rocket 10 is hollow, making the base portion of the toy article 10, easily mountable upon a fluid nozzle 11 for launching. As is typically found in rockets in general, the base end of the body 20 has fins 22 attached.

Figures 2, 3:
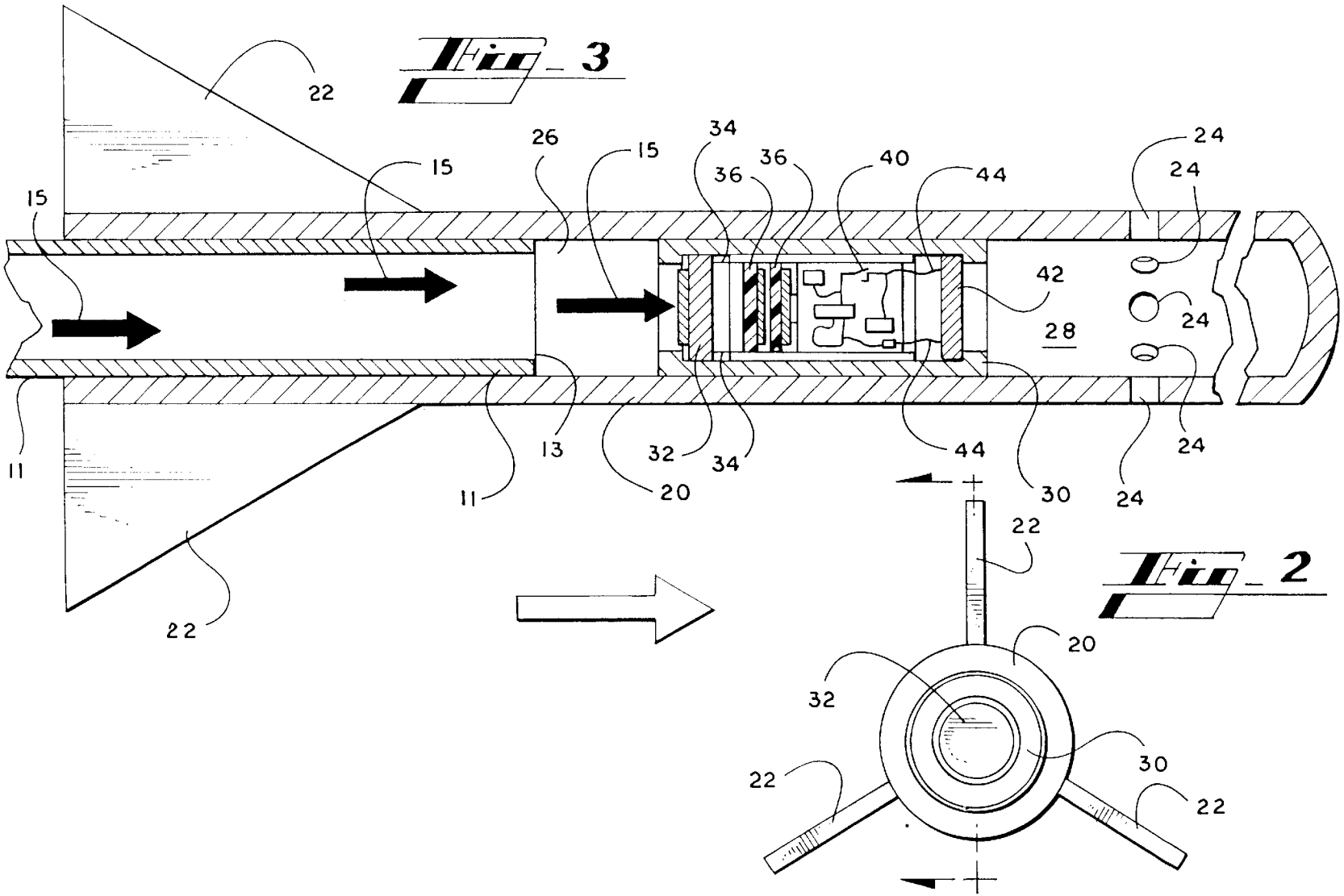
FIG. 2 is an end view of the rocket of FIG. 1 from its base.
FIG. 3 is a sectional view of the rocket of FIG. 1.

For a clearer understanding of the invention simultaneous reference may now be made to FIGS. 1, 2 and 3, as additional features of the invention are discussed. The interior of the base end of the rocket body 20 essentially forms a fluid chamber 26 which terminates at the sound-generating unit housing 30. Although other approaches are possible, the sound-generating unit housing is a convenient means of encasing the elements described below and providing an effective seal for the fluid chamber 26 portion of the rocket 10. The housing 30 of the sound-generating unit is positioned within the hollow rocket body 20 with one end (the posterior end) facing the fluid chamber 26 and in direct alignment with the opening 13 of the nozzle 11. The other end (anterior end, for reference) of the sound-generating unit housing 30 faces the forward end of the rocket body 20. A resonance chamber 31 is formed at the anterior end of the housing 30. Apertures 24 through the body of the rocket 10 permit sound broadcasted by the speaker 42 located at the front of the sound-generating unit housing 30 and passing through the resonance chamber 31 to emanate from the rocket 10. A piezoelectric element 32 is positioned at the posterior end of the sound-generating unit 30, facing the fluid chamber 26 and opening at the base end of the rocket body 20. As can be seen in FIGS. 2 and 3 the piezoelectric element 32 is positioned in an opening of the sound-generating unit housing 30 so that it may receive a burst of propelling fluid 15. A thin piezoelectric disk is particularly suitable for use in the invention. An example of such a thin piezoelectric disk element is the disk manufactured by the company known as Vernitron and sold under the trademark Unimorph®.

Reference will now be made particularly to FIG. 3 to describe the contents of the sound-generating unit 30 in greater detail. As has been previously mentioned in part, the rear and front of the sound-generating unit housing 30 have openings into which the piezoelectric unit 32 and loudspeaker 42 are respectively positioned. The housing 30 further contains batteries 36 and the sound-generating electronic circuitry 40 energized by the batteries 36. Wires 34, 44 connecting the piezoelectric element 34 and loudspeaker 42 respectively to the electronic circuit 40 are also shown.

In operation, the toy article 10, is impaled upon the nozzle 11 for launching. When the burst of compressed or pressurized fluid 15 (such as air or water, respectively) is directed from the nozzle opening 13 through the fluid chamber 26, the positioning of the piezoelectric element 32 causes the element 32 to receive the mechanical pressure exerted by the force of the fluid 15. The mechanical pressure exerted upon the piezoelectric element 32 causes the element 32 to deform and thereby produce a voltage signal. The voltage signal is processed by the electronic circuitry 40 to produce a predetermined sound effect that is broadcasted by the loudspeaker 42. The resonance chamber 31 reinforces and enhances the sound from the speaker 42.

It is to be noted that deformation of the piezoelectric element 32 and the accompanying actuation of the switch is caused by a change in relative motion which is imparted to the element 32. As described immediately above, the projectile and element 32 are at rest when the element 32 is impinged by a burst of fluid pressure 15 which produces deformation. However, the nature of a suitable piezoelectric element 32 is such that deformation occurs not only when the element is at rest but also when the element is accelerated into motion, in motion and decelerated and in motion and brought to an abrupt stop. In these instances although the surface of the element itself is not directly impacted deformation is still achieved by the change in relative motion which thereby causes movement, that is, deformation of the element 32. Upon acceleration of the body 20 of the projectile from rest, the gravitational, or "g," force due to acceleration of the projectile is in turn imparted to the element 32. In another instance, a change from motion to a condition of interruption of motion also causes deformation, and hence actuation of the switch. For example, if the projectile body is in motion and comes into contact with a resistive force, such as when a projectile strikes the ground or other immovable object, an impact or vibratory force is imparted to the projectile body 20 and element 32. The vibratory force causes deformation of the piezoelectric element and, thus, actuation of the switch.

Figure 4:
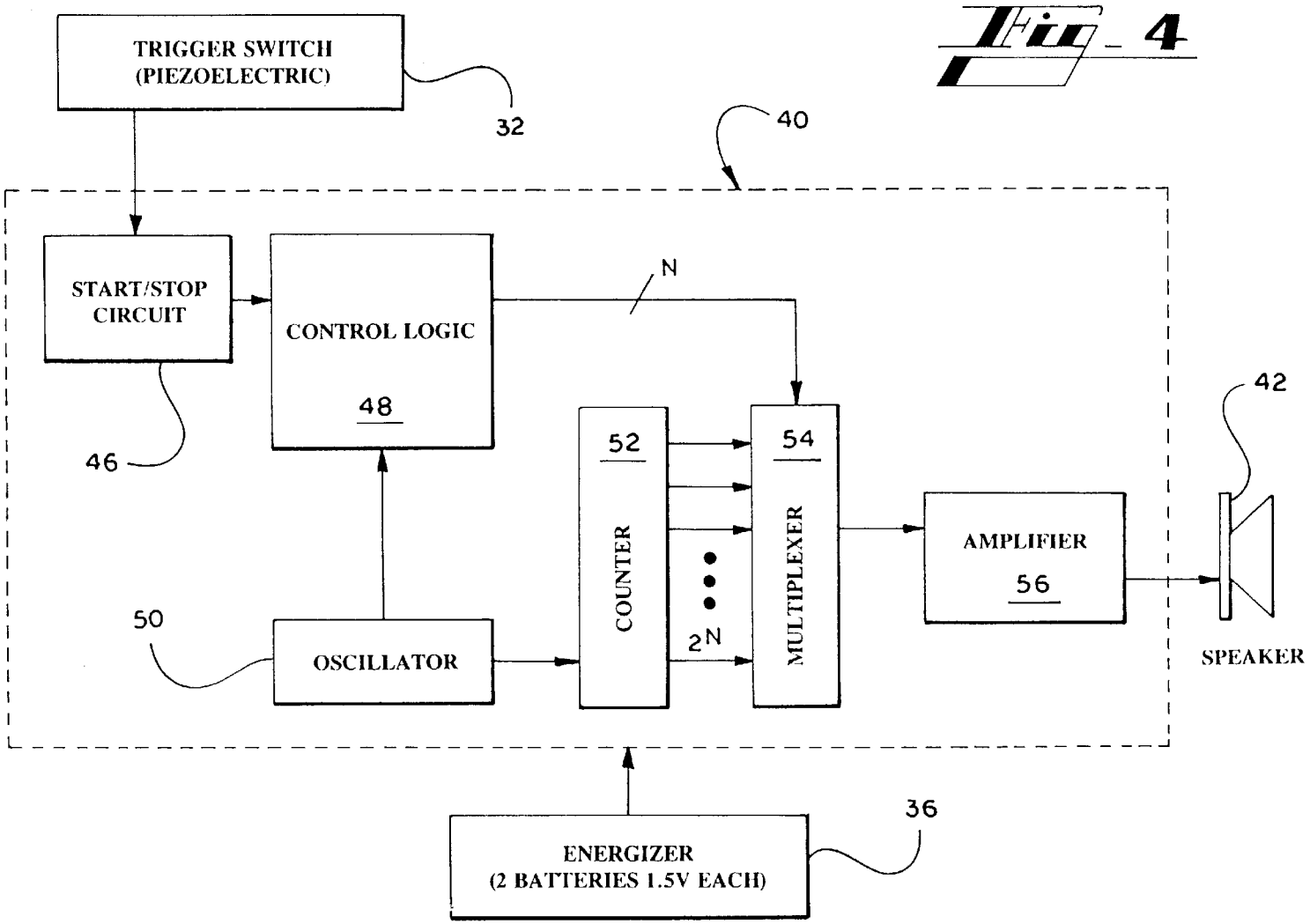
FIG. 4 is a schematic block diagram of a typical sound-generation electronic circuit for the rocket of FIG. 1.

Referring now to FIG. 4, typical but non-exclusive sound-generating electronic circuitry 40 is shown in schematic block diagram form. The circuit contains typical, conventional elements for signal processing and sound generation. The circuit 40 is powered by conventional energizing means such as miniature disk-shaped batteries used in watches and similar small electronic devices. The piezoelectric element 32 is in essence a trigger switch which sends a signal to a typical stop-start circuit component indicated by the functional block denoted 46. The start-stop circuitry 46, such as two D type flip-flops configured to form a one-shot circuit, initiates signal processing. The output pulse from the one-shot is connected to the control logic 48, where a configuration of combinational logic gates generates a sequence of output signals which are then passed to the select inputs of a multiplexer 54. An on-chip oscillator 50, a d-type flip-flop counter 52 and the multiplexer 54 generate the sound effect that is then passed through an amplifier 56 to the loudspeaker 42.

In operation, the rocket 10 is impaled upon the nozzle 11 for launching. As described above, the sound-generating unit housing 30 effectively closes off the hollow body 20 of the rocket 10. Examples of fluid which may be used to impel the toy article 10 from the nozzle are compressed air or pressurized water. These fluids may be respectively compressed or pressurized and subsequently directed through the nozzle 11 in a burst by any known means such as a pump and trigger. When the burst of fluid 15 is released from the nozzle 11 the nozzle 11 is maintained in a stationary position while the rocket body 20 is impelled from the nozzle. The fluid burst 15 exerts mechanical pressure upon the piezoelectric element 32 causing the piezoelectric element 32 to generate a voltage. The voltage is a signal that is processed by the sound-generator circuitry 40 to produce and amplify a designated sound effect. The resonance chamber 31 reinforces the sound generated. A suitable resonance chamber may also be provided by the portion of the rocket body extending between the sound-generating unit housing and the apertures 24, or affixation of a chamber within the rocket body. However, the illustrated embodiment of a resonance chamber 31 works well to enhance sound generation. Sound ultimately passes through the apertures 24 making the designated sound effect audible in conjunction with the launching of the rocket 10. Typical simulated sounds generated include the whistling sound made by a projectile as it passes through the air. Optionally the whistling sound may be followed by an explosion-type sound. The explosion type sound is triggered through conventional circuitry means to occur either at a predetermined time after the initiation of the whistling sound or is triggered when the toy 10 is impacted.

Figure 5:
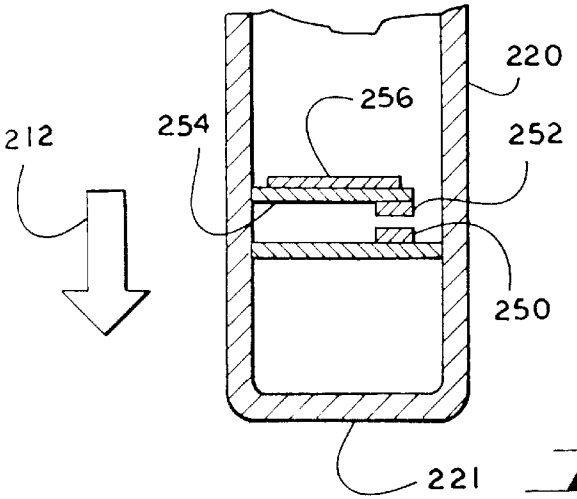
FIG. 5 is a partially cut-away sectional illustration of a sound-generating toy foam rocket according to another preferred embodiment of the present invention.

Referring now to FIG. 5, therein is illustrated in a partial sectional view a sound-generating rocket according to another preferred embodiment of the invention. In this embodiment sound is generated upon impact of the rocket. Although several mechanisms may be used to provide switch closure upon impact the preferred embodiment of FIG. 5 illustrates the general principle wherein a circuit is at least momentarily closed by the force of impact. For example, contacts 250 and 252 are caused to close upon impact of the front 221 of the rocket body 220 due to a sudden cessation of movement of the rocket body 220 in the direction indicated by the direction arrow 212. The upper contact 252 may be mounted upon a spring member 254 biased in an open position. Momentum and the force of gravity, enhanced by a weight member such as 256, causes the contacts 250, 252 to close at least momentarily, triggering the circuit previously described.

Figure 6:
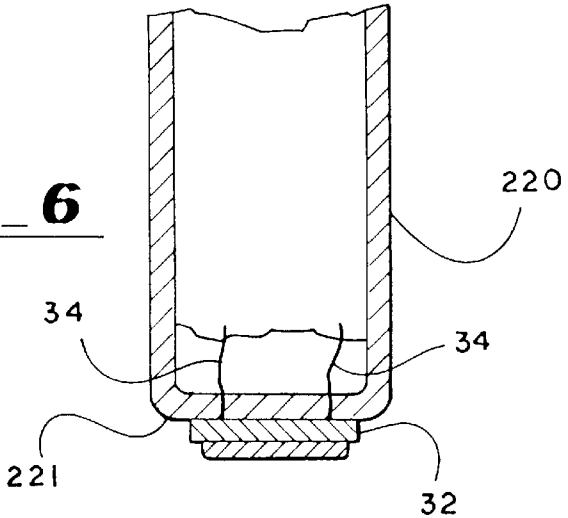
FIG. 6 is a partial sectional illustration of a sound-generating toy foam rocket according to still another preferred embodiment of the present invention.

Referring now to FIG. 6, therein is illustrated in a partially cut-away partial sectional view a sound-generating rocket according to still another preferred embodiment of the invention. In this illustration features identical to those previously described bear the same identification numerals previously used, particularly in FIG. 5. In this embodiment, the switch which triggers sound generation is a piezoelectric type 32 as described above mounted upon the anterior-most portion of the anterior end 221 of the rocket body 220. In this manner the piezoelectric switch 32 is impacted, and caused to operate, upon impact of the rocket with a resisting surface.

As should be apparent from the foregoing specification, the invention is susceptible of being modified with various alterations and modifications which may differ from those which have been described in the preceding specification and description. For example, although the invention has been described by reference to a toy foam-rocket, the teachings of the invention are also applicable to a fluid-launchable toy car or boat, or similar toy vehicle, or projectile in general. Accordingly, the following claims are intended to cover all alterations and modifications which do not depart from the spirit and scope of the invention.

What is claimed is:

1. A toy projectile launchable by a burst of fluid pressure comprising:

a projectile-shaped body including aerodynamic means for enhancing flight having means for being positioned relative to a source of the fluid pressure for receiving the burst of fluid pressure and causing said body to be propelled thereby;

an electromechanical transducer switch positioned with respect to said means for receiving the burst of fluid pressure such that said electromechanical transducer switch will be impinged by the burst of fluid pressure received as said body is initially propelled and will thereby trigger a signal in response thereto;

an electronic circuit triggerable by said electromechanical transducer switch including electronic elements for generating a predetermined sound effect when said signal is received; and a loudspeaker for broadcasting said predetermined sound effect when said electronic circuit is triggered;

wherein when said body is propelled by the burst of fluid pressure said electronic circuit is triggered.

2. The toy projectile of claim 1, said means for being positioned relative to a source of the fluid pressure for receiving the burst of fluid pressure comprising a bore for being impaled upon a nozzle and wherein said electromechanical transducer switch is positioned within said bore in alignment with said nozzle to receive said burst of fluid pressure from said nozzle.

3. The toy projectile of claim 2, said electromechanical transducer switch comprising a piezoelectric element.

4. The toy projectile of claim 3, said piezoelectric element comprising a thin piezoelectric disk.

5. The toy projectile of claim 1, further comprising a resonance chamber disposed adjacent said loudspeaker.

6. The toy projectile of claim 1, wherein said body has at least one aperture extending therethrough proximate said loudspeaker.

7. A system for launching a toy projectile by a burst of fluid pressure comprising:

a launcher including means for projecting a burst of fluid under pressure and a port through which said fluid under pressure is projected;

a toy projectile including a body having means for positioning the toy projectile in relation to said launcher such that the toy projectile may receive and be propelled by said burst of fluid pressure;

an electromechanical transducer switch positioned with respect to said means for receiving the burst of fluid pressure such that said electromechanical transducer switch will be impinged by the burst of fluid pressure received;

an electronic circuit triggerable by said electromechanical transducer switch including electronic elements for generating a predetermined sound effect; and a loudspeaker for broadcasting said predetermined sound effect when said electronic circuit is triggered.

8. The system of claim 7, including a nozzle disposed in relation to said port and said toy projectile for projection of the burst of fluid through said nozzle, said means for receiving the burst of fluid pressure including a bore for being impaled upon said nozzle and wherein said electromechanical transducer switch is positioned within said bore in alignment with said nozzle to receive said burst of fluid pressure from said nozzle.

9. The system of claim 8, said electromechanical transducer switch comprising a piezoelectric element.

10. The system of claim 9, said piezoelectric element comprising a thin piezoelectric disk.

11. The system of claim 7, the toy projectile further including a resonance chamber disposed adjacent said loudspeaker.

12. The system of claim 7, wherein said body has at least one aperture extending therethrough proximate said loudspeaker.

13. A toy article comprising:

a body having an exterior surface in the configuration of a projectile including aerodynamic means for enhancing flight thereto, having means for receiving a launching mechanism and having a nose portion disposed such that when said body travels upon being launched said nose assumes an anterior-most position with respect to said body;

an electromechanical transducer switch mounted upon said nose portion at the anterior-most point thereof such that when said body is launched and said nose portion impacts a surface providing resistance said electromechanical transducer switch is impacted thereby and actuated; and an electronic circuit triggerable by said electromechanical transducer switch including electronic elements for generating a predetermined sound effect; and a loudspeaker for broadcasting said predetermined sound effect when said electronic circuit is triggered.

14. The toy article of claim 13, said electromechanical transducer switch comprising a piezoelectric element.

15. The toy article of claim 14, said piezoelectric element comprising a thin piezoelectric disk.

* * * * *